United States Patent [19]

Focke et al.

[11] Patent Number: 4,508,218

[45] Date of Patent: Apr. 2, 1985

[54] SOFT CIGARETTE PACK

[75] Inventors: Heinz Focke; Kurt Liedtke, both of Verden, Fed. Rep. of Germany

[73] Assignee: Focke & Co., Verden, Fed. Rep. of Germany

[21] Appl. No.: 513,958

[22] Filed: Jul. 15, 1983

Related U.S. Application Data

[63] Continuation of Ser. No. 383,072, May 28, 1982.

[30] Foreign Application Priority Data

Jun. 19, 1981 [DE] Fed. Rep. of Germany ..... 3124118

[51] Int. Cl.[3] ..... B65D 85/10

[52] U.S. Cl. ..... 206/271; 206/259; 206/273; 229/5.6; 229/87 C

[58] Field of Search ..... 206/259, 271, 273; 229/87, 48 R, 48.5 A, 5.6

[56] References Cited

U.S. PATENT DOCUMENTS

| | | | |
|---|---|---|---|
| 1,970,349 | 8/1934 | Wall | 229/87 C |
| 2,268,970 | 1/1942 | Tindal | 229/87 C |
| 2,913,165 | 11/1959 | Jacke | 229/87 C |

*Primary Examiner*—William T. Dixson, Jr.
*Assistant Examiner*—David T. Fidei
*Attorney, Agent, or Firm*—Sughrue, Mion, Zinn, Macpeak, and Seas

[57] ABSTRACT

In the production of soft packs for receiving cigarettes or the like it is important, where possible, to save material, while maintaining the functional characteristics of the pack, on the one hand, and its external appearance. For this reason, the proposed (soft) pack consists of a single one-piece blank made especially of paper or the like. By special folding in the region where the pack envelope merges into the end wall, an offset or a step with an upper edge rim is formed here, and this gives the external impression of a conventional cup pack and moreover imparts increased dimensional stability to the pack.

8 Claims, 8 Drawing Figures

SOFT CIGARETTE PACK

This application is a continuation of application Ser. No. 383,072, filed May 28, 1982.

BACKGROUND OF THE INVENTION

The invention relates to a pack made of foldable packaging material, especially a cuboid (soft) cigarette pack, consisting of at least one main blank made of paper, cardboard, plastic foil or the like, which forms the front, rear and side walls and the bottom and end walls of the pack.

The construction of cigarette packs is a special subject in packaging technology. On the one hand, because of market requirements the construction of these packs is very expensive. On the other hand, it is desirable to reduce the amount of material used because of the extremely large quantities of packs of this type.

The (cuboid) cigarette packs with which the invention is concerned belong to the category of soft packs. Conventional soft packs consist of a main blank made of paper. This is usually shaped in the form of a cup, that is to say with a (folded) bottom wall and an open end face. The inner blank, conventionally a tin foil blank, together with the wrapped block of cigarettes projects from this. An outer wrapping consists predominantly of transparent film, but recently also of a plastic foil, for example polypropylene, which is moisture-proof and aroma-proof has also been used.

It is obvious that this "three-part" soft pack is especially expensive in terms of material, yet without giving favourable values as regards impermeability. To reduce the amount of material used, a soft pack consisting as a whole of only a single one-piece blank has already been proposed. This is provided in the region of the (folded) end wall with a silver-coloured print to simulate the presence of an inner blank made of tin foil. In this known design, the front, rear and side walls are printed from the same blank, so that the impression of a cup made of paper arises.

Although this soft pack meets the need for a savings of material, nevertheless it differs far too much from conventional soft cup packs in terms of its construction and, above all, in its external appearance. In addition, the single blank is not suitable for giving the pack a certain minimum stability and firmness of shape.

SUMMARY OF THE INVENTION

With the foregoing as a basis, the object on which the invention is based is to provide a pack, specifically, in particular, a (soft) cigarette pack which, on the one hand, saves material to a considerable extent, but, on the other hand, preserves the external appearance of a conventional soft pack and moreover has increased dimensional stability.

To achieve this object, the pack according to the invention is characterised in that the main blank is provided, at the upper and/or lower edge of the front and/or rear and/or side walls, with a strip-shaped reinforcement formed by a thickening of material.

The pack according to the invention preferably consists likewise, of a single (main) blank made of paper or the like. However, there can be, in addition, an outer wrapping made of transparent film or preferably a plastic foil which is moisture-proof and aroma-proof. According to the invention, the upper region of the pack on the end face is printed in a silver colour, so that the impression from the outside of an inner wrapping consisting of a tin foil blank is preserved. According to a preferred exemplary embodiment, the strip-shaped reinforcement is arranged at least at the upper edge of the pack extending all-round, in such a way that the pack envelope formed by the front, rear and side walls is delimited by a clearly discernable rim from the part of the blank (main blank) forming the end wall. For this purpose, according to a further proposal of the invention, the reinforcement is formed on the inside, so as to extend all-round, at the upper edge of the pack envelope, specifically preferably by a Z-fold in the (main) blank. On the one hand, this produces the desired offset of the end wall relative to the pack envelope, and moreover guarantees an all-round stiffening of the pack.

For the same reason, this reinforcement can also be formd in the lower region of the pack, preferably at the lower edge for the purpose of delimitation from the bottom wall.

The (single) blank can be designed in various ways within the scope of the invention. The envelope surface can have a print which corresponds to a conventional soft cup pack. It is especially appropriate to provide a coating which gives this main blank, on the whole, a higher impermeability towards losses of aroma and moisture, for example a metallic layer. Appropriately, the blank as a whole is provided with an outer metallic layer which forms, at the same time, the outer coating in the region of the end wall. The pack envelope and appropriately the bottom wall are then provided, in addition, with a (coloured) print.

According to the invention, the reinforcement formed by a Z-fold directed inwardly is made in or on a continuous sheet of packaging material for producing the blanks. This Z-shaped folding can be carried out within the packaging machine so that finished blanks to be processed directly can be severed.

Further features of the invention relate to the formation of the pack in terms of construction and material and to the production of blanks.

BRIEF DESCRIPTION OF THE DRAWINGS

Exemplary embodiments of the pack and examples of the production of the blanks are explained in more detail below with reference to the drawings in which.

DETAILED DESCRIPTION OF THE PREFERRED EMBODIMENTS

The packs illustrated as an exemplary embodiment in the present case are cuboid soft packs for receiving cigarettes 10. The packs consist of a (main) blank 11 or 12. A further outer wrapping in the form of a transparent-film or plastic-foil wrapper can be provided if appropriate.

Figure 2:
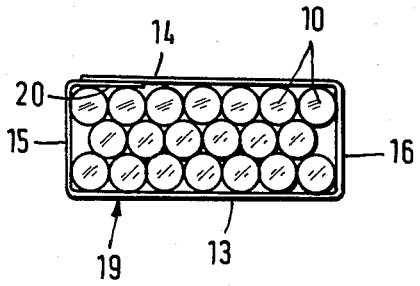
FIG. 2 shows a horizontal section along the line II—II in FIG. 1.

The pack is limited by the front wall 13, rear wall 14 and side walls 15 and 16 and by the bottom wall 17 and end wall 18. The front wall 13, rear wall 14 and side walls 15, 16 form a pack envelope 19. The pack is, moreover, constructed on the principle of side closure. A connecting tab 20 connected to the inner side of the rear wall 14 adjoins a side wall 15 (FIG. 2). Both the bottom wall 17 and the end wall 18 consist of folded-over longitudinal tabs 21 and side tabs 22. These are folded in a conventional known way against the underside and top side of a cigarette block formed by the cigarettes 10. The longitudinal and side tabs 21,22 partially overlapping one another are connected to one another by gluing or thermal welding in such a way that substantial impermeability of the bottom and end walls 17, 18 is guaranteed.

Figure 1:
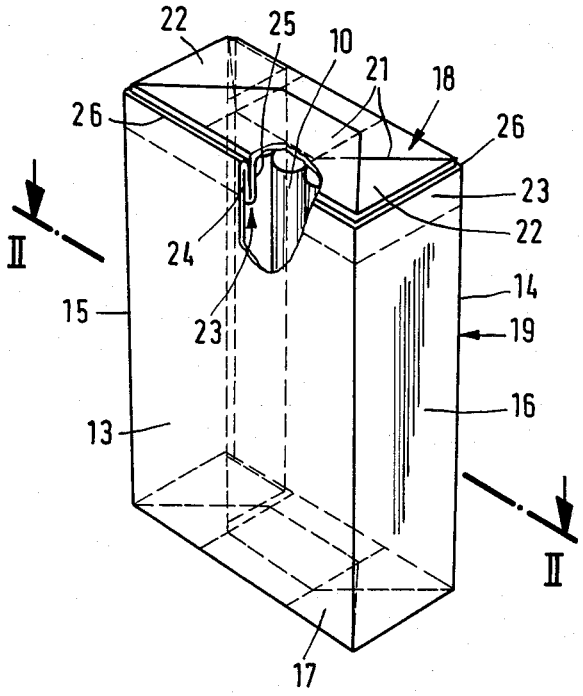
FIG. 1 shows a cuboid soft pack for cigarettes, in a perspective representation and with a cut-out.

The pack is provided with a reinforcement in the region of the pack envelope 19. In the exemplary embodiment of FIG. 1, a thickening of material, specifically in the form of a Z-fold 23, extending all-around and arranged on the inside is formed at the upper edge of the pack envelope 19. This is formed as part of the blank 11 or 12 by appropriate folding, so that two legs of material 24,25 rest against one another as a result of being folded through 180° and together form, on the inside of the pack, the thickening of the material or the strip-shaped reinforcement. The outer leg of material 24 immediately adjoins the upper edge of the pack envelope 19, whilst the inner leg of material 25 is assigned to the end wall 18 and merges into this.

The dimensions are such that the outer leg of material 24 is somewhat shorter than the inner leg of material 25. As a result, the latter projects somewhat beyond the pack envelope 19. Because of this Z-fold 23 and the above-mentioned differences in dimensions, there arises in this region an upper edge rim 26 which is formed by folding-over and which has the visual effect of terminating the pack envelope 19. In relation to the latter, the inner leg of material 25 assigned to the end wall 18 is set back inwards by the amount of two layers of material. This gives the impression that a cuboid (cigarette) block is located in a cup-shape wrapping.

Figure 5:
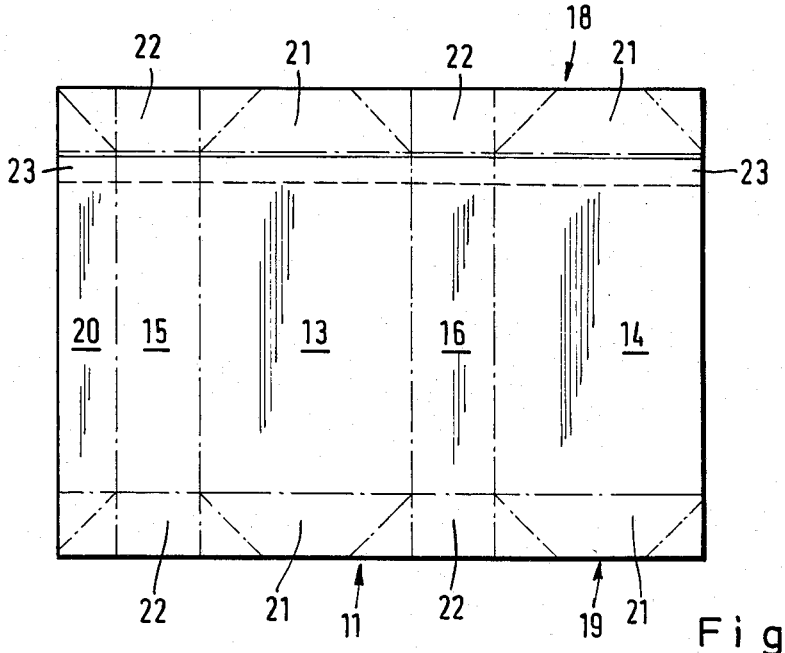
FIG. 5 shows the blank for this pack in a spread-out state.
Figure 6:
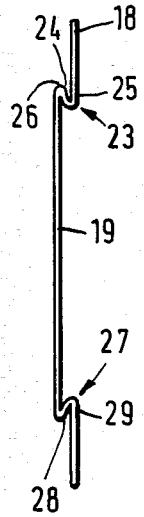
FIG. 6 shows a representation corresponding to FIG. 4 for the exemplary embodiment according to FIG. 3.
Figure 7:
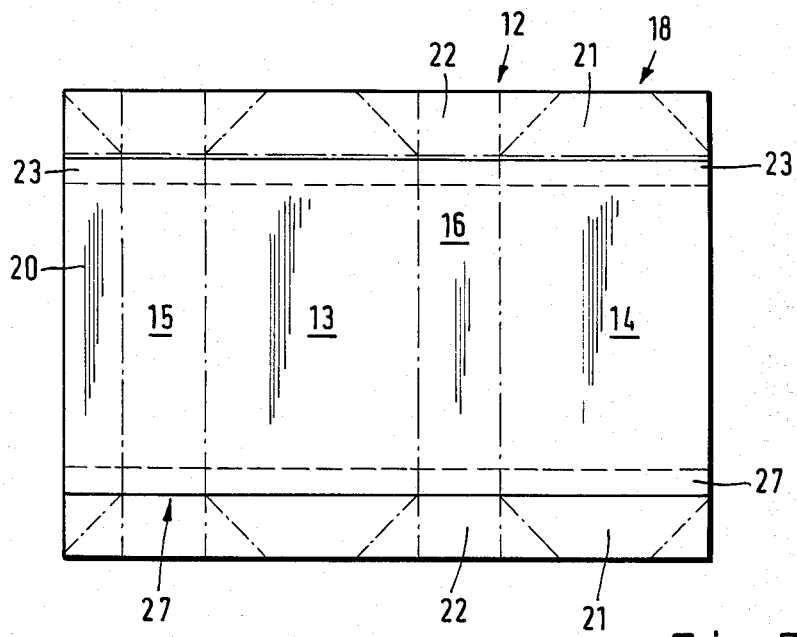
FIG. 7 shows the blank of FIG. 6 in a spread-out position.

The Z-fold 23 extends over the entire length of the blank 11 or 12 (FIGS. 5 and 7). In the finished pack, this results in a continuous stiffening on its inside. This also makes it easier to tear off a longitudinal or side tab 21, 22 of the end wall 18 so as to open the pack.

Figure 3:
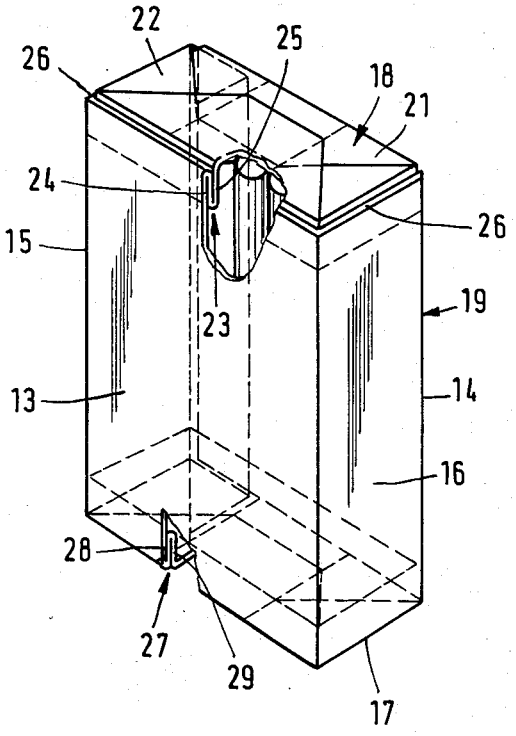
FIG. 3 shows a perspective representation, similar to FIG. 1, of another exemplary embodiment of the pack.
Figure 4:
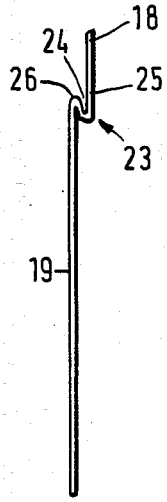
FIG. 4 shows a cross-section (vertical section) through a blank for a pack according to FIG. 1.

In the exemplary embodiment of FIG. 3, there is, in addition to the reinforcement provided on the end face by the Z-fold 23, also, adjacent to the bottom wall 17, a reinforcement (on the inside) provided by a further Z-fold 27. This is designed in the same way as the Z-fold 23, that is to say with legs of material 28 and 29. As is evident especially from FIG. 3, the abovementioned legs of material 28,29 are, however, made with the same length, so that the pack envelope 19 merges into the bottom wall 17 steplessly or free of offset. In fact, only a (rounded) conventional pack rim is formed here.

In the design with two reinforcements, the pack acquires, to that extent, a symmetrical construction with even greater dimensional stability.

Figure 8:
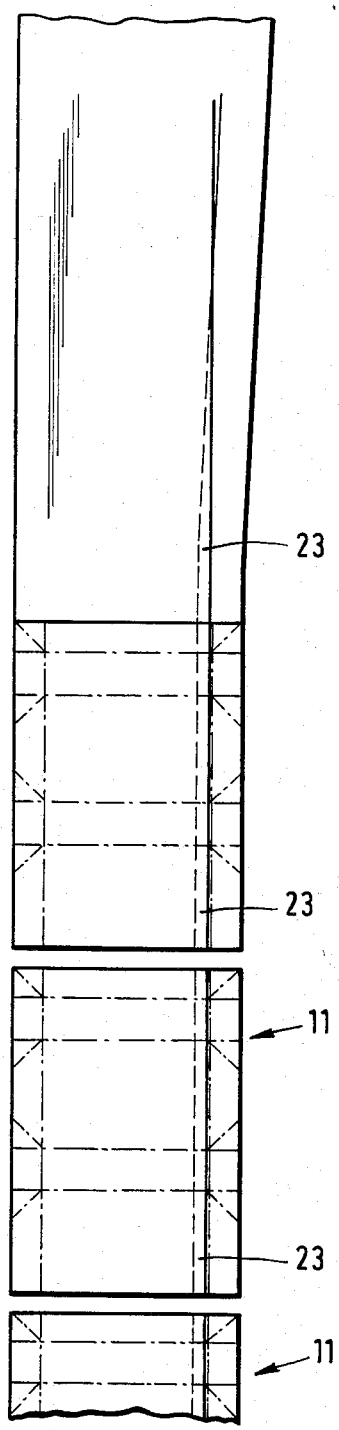
FIG. 8 shows, in horizontal projection, the production of blanks from a sheet of packaging material for a pack according to FIG. 1.

In the exemplary embodiment illustrated, the Z-folds 23 and 27 respectively are already made on the unfolded blank 11 and 12 respectively, specifically continuously over the full length. According to the arrangement of FIG. 8, the blanks are severed in succession, preferably within the packaging machine, from a sheet 30 of packaging material. The Z-fold 23 (if appropriate, also the Z-fold 27) is previously formed as a continuous Z-fold in the region of the sheet 30 at the required location, namely at a lateral edge. Such Z-shaped folding of a relatively thin strip of material can be mastered easily using packaging technology. After the Z-fold 23 or 27 has been made, the individual blanks 11, 12 are severed from the sheet 30 preformed in this way.

The Z-folds 23, 27 require no special measures for fixing. However, provision can be made for the legs of material 24,25 and 28,29 respectively, to be connected to one another or to the inner side of the pack envelope 19 by gluing or thermal welding. This fixing, if appropriate, point-fixing, of the Z-fold 23, 27 can be carried out even within the sheet 30.

The blanks 11, 12 or the sheet 30 are designed especially for producing the packs described. At least the region of the end wall 18 and of an adjoining part of the Z-fold 23, especially the inner leg of material 25, is provided with a silver- or gold-coloured metallic coating, so that this part of the blank 11, 12, projecting from the pack envelope 19, gives the impression of a tin foil blank. The remaining part of the blank 11, 12 is preferably provided with a print in keeping with the formation of a cup of a soft cup pack. It may be advantageous, here, to allow the metallic coating to extend over the entire blank 11,12, so as to ensure, on the one hand, an especially smooth surface, but, on the other hand, increased impermeability against losses of aroma and moisture. To delimit the pack envelope 19 from the end wall 18, the metallic outer layer of the pack envelope 19 can be provided with a suitable covering overprint.

Finally, it may be expedient to provide the blank 11 or 12 on the inside with a coating which likewise serves to increase impermeability, for example with a wax coating.

The blanks 11 or 12 can be processed in a simple way in packaging terms, especially by using a hollow mandrel as a shaping packaging member.

We claim:

1. A package made of a foldable packaging material, comprising; at least one main blank forming front, rear and side walls and bottom and end walls, said main blank being transversely wrapped and being provided with reinforcement portions comprising Z-folds extending along upper and lower edge portions of said front, rear and side walls, said Z-folds being disposed on the inside of the package and terminating at upper and lower edges flush with respective upper and lower edges of a package envelope formed by said front rear and side walls, portions of said blank extending directly from termination lines of said Z-folds extending over upper and lower faces of said package.

2. A package according to claim 1, characterized in that each of said Z-folds is provided as a strip extending around the entire package.

3. A package according to claim 1, wherein the Z-fold (23) arranged adjacent to the end wall (18) is formed by two legs of blank material, the leg (25) facing the end wall and adjoining the latter being wider than the leg (24) adjoining the pack envelope (19), in a manner such that the leg (25) projects beyond the leg (24) and an upper edge rim (26) formed by the pack envelope.

4. A package according to claim 3, wherein legs (24, 25) of the Z-fold (23) are connected to one another and to adjoining regions of the pack envelope by gluing or welding.

5. A package according to claim 1, wherein said main blank is provided, at least in the region of the end wall (18), with a coating of metallic appearance.

6. A package according to claim 1, wherein an outer side of said main blank is provided, in at least the region of said package envelope, with a leak-proof coating.

7. A package according to claim 1, wherein said main blank is comprised of paper provided on its inner side with a coating which promotes impermeability.

8. A package according to claim 6, wherein said leak proof coating is a metallic coating having a print in the region of said package envelope.

* * * * *